United States Patent [19]

Derichs

[11] Patent Number: 4,539,804

[45] Date of Patent: Sep. 10, 1985

[54] METHOD AND APPARATUS FOR STARTING THE OPERATION OF A FRICTION SPINNING MACHINE

[75] Inventor: Josef Derichs, Mönchen-Gladbach, Fed. Rep. of Germany

[73] Assignee: W. Schlafhorst & Co., Möenchen-Gladbach, Fed. Rep. of Germany

[21] Appl. No.: 609,772

[22] Filed: May 14, 1984

[30] Foreign Application Priority Data

May 13, 1983 [DE] Fed. Rep. of Germany ..... 3317369

[51] Int. Cl.[3] ..... D01H 15/02; D01H 1/135

[52] U.S. Cl. ..... 57/263; 57/279; 57/401

[58] Field of Search ..... 57/22, 261, 263, 279, 57/280, 300, 301, 304, 305, 400, 401, 332, 334, 335, 337, 338, 348, 352, 353

[56] References Cited

U.S. PATENT DOCUMENTS

| | | | |
|---|---|---|---|
| 3,593,511 | 7/1971 | Guinard et al. | 57/280 |
| 4,059,948 | 11/1977 | Derail et al. | 57/280 |
| 4,168,601 | 9/1979 | Didek et al. | 57/401 |
| 4,315,398 | 2/1982 | Parker et al. | 57/401 |
| 4,327,545 | 5/1982 | Fehrer | 57/401 X |
| 4,334,400 | 6/1982 | Fehrer | 57/401 X |
| 4,367,623 | 1/1983 | Parker et al. | 57/263 |
| 4,399,650 | 8/1983 | Parker et al. | 57/401 |

*Primary Examiner*—Donald Watkins

*Attorney, Agent, or Firm*—Herbert L. Lerner; Laurence A. Greenberg

[57] ABSTRACT

A method for starting the operation of a friction spinning machine, including friction surfaces movable in opposing directions for forming a spinning wedge; the friction surfaces being movable in a spinning direction during a spinning operation, a device for supplying fiber to the spinning wedge, at least one suction device acting on the spinning wedge, a suction tube supplied with suction air, and a thread withdrawal device includes:

stopping the fiber supply and the motion of the friction surfaces;

stopping the suction;

moving the suction tube through the spinning wedge in a given direction for sucking in thread and fiber remains;

subsequently sucking a thread through the suction tube; moving the suction tube out of the spinning wedge in a direction opposite said given direction depositing the thread in the spinning wedge;

resuming the suction at least as late as the step of moving the suction tube out of the spinning wedge;

moving the friction surfaces in a direction opposite the spinning direction removing the twist of the thread and loosening the thread;

subsequently stopping the motion of the friction surfaces again;

starting the fiber supply again;

moving the friction surfaces in the spinning direction with increased speed; and coordinating and increasing the fiber supply, the motion of the friction surfaces and the thread withdrawal until a normal spinning operation is established, and an apparatus for carrying out the method.

5 Claims, 2 Drawing Figures

METHOD AND APPARATUS FOR STARTING THE OPERATION OF A FRICTION SPINNING MACHINE

The invention relates to a method and an apparatus for starting the operation of a friction spinning machine, especially for eliminating a thread break, including friction surfaces moving in opposing directions for forming a spinning wedge, a fiber supply device, a thread withdrawal device, and at least one suction device acting on the spinning wedge.

The friction surfaces of a friction spinning machine of this type may be in the form of two closely adjacent perforated drums, rotating in the same sense or direction, which form a spinning wedge therebetween. The spinning fibers are usually introduced from the top into the spinning wedge in a dissolved form. Disposed in the interior of at least one of the perforated drums is a stationary suction device having a suction-slit directed toward the spinning zone and ending just close enough to the wall of the drum, so that the drum can still rotate freely.

Friction spinning machines of this type permit automatic spinning operations. The start up of such a friction spinning machine is done manually. Repairs which are made after the thread has broken, are done by hand, and therefore depend on the manual dexterity of the operator. The quality of the point at which the thread is joined and connected varies a great deal, and depends on chance, and especially on the dexterity of the person performing the task.

It is accordingly an object of the invention to provide a method and apparatus for starting the operation of a friction spinning machine, which overcomes the hereinafore-mentioned disadvantages of the heretofore-known methods and apparatus of this type, and to automate the start of the operation of a friction spinning machine as much as possible, in particular for restarting the spinning operation after the thread has broken.

With the foregoing and other objects in view there is provided, in accordance with the invention, a method for starting the operation of a friction spinning machine, especially for eliminating a thread break, including friction surfaces movable or rotatable in opposing directions for forming a spinning wedge, the friction surfaces being movable in a spinning direction during a spinning operation, a device for supplying fiber to the spinning wedge, at least one suction device acting on the spinning wedge, a suction tube supplied with suction air, and a thread withdrawal device, which comprises:

stopping the fiber supply and the motion or rotation of the friction surfaces;

stopping the suction;

moving the suction tube forward through the spinning wedge in a given direction for sucking in thread and fiber remains;

subsequently sucking a thread or thread end to be joined through the suction tube;

moving the suction tube back out of the spinning wedge in a direction opposite said given direction depositing the thread in the spinning wedge;

resuming the suction at least as late as the step of moving the suction tube out of the spinning wedge;

moving or rotating the friction surfaces in a direction opposite the spinning direction removing the twist of the thread and loosening the thread or thread end;

subsequently stopping the motion of the friction surfaces again;

starting the fiber supply again;

moving or rotating the friction surfaces in the spinning direction with increased speed; and coordinating and increasing the fiber supply, the motion or rotation of the friction surfaces and the thread withdrawal until a normal spinning operation is established.

In accordance with another mode of the invention, there is provided a method which comprises holding the thread in a fixed position outside the spinning wedge, at least during the step of removing the thread twist.

In accordance with a further mode of the invention, there is provided a method which comprises loosening the fiber formation or bond during the step of removing the thread twist, separating the thread with the suction air, and sucking away a severed thread portion.

In order to carry out the method, there is provided an apparatus for starting the operation of a friction spinning machine, especially for eliminating a thread break, including friction surfaces movable or rotatable in opposing directions for forming a spinning wedge, a device for supplying fiber to the spinning wedge, a thread withdrawal device for withdrawing thread in a given direction, and at least one suction device acting on the spinning wedge, comprising a suction tube supplied with suction air, the suction tube being movable back and forth through the spinning wedge along the given thread withdrawal direction and a direction opposite thereto.

The advantage obtained by practicing the invention can be found especially in the fact that the start of the spinning operation or the repair of a broken thread after a thread breakage is performed rapidly and reliably. Accidental occurrences depending on manual dexterity are avoided. The quality of the thread connection is therefore improved.

Other features which are considered as characteristic for the invention are set forth in the appended claims.

Although the invention is illustrated and described herein as embodied in a method and apparatus for starting the operation of a friction spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments, when read in connection with the accompanying drawings, in which.

Figure 2:
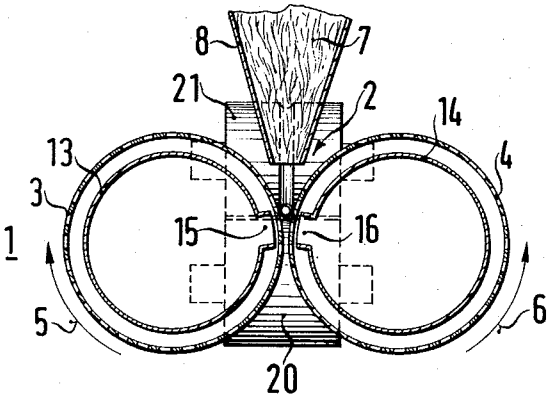
FIG. 2 is a cross-sectional view of the device according to FIG. 1 on a somewhat larger scale.
Figure 1:
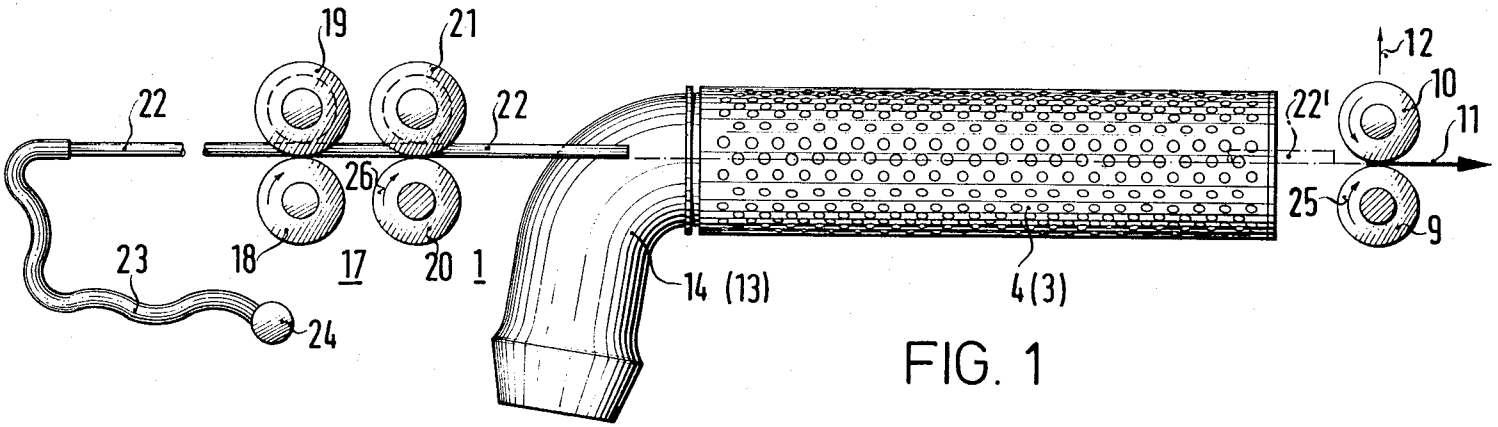
FIG. 1 is a side-elevational view of the device according to the invention.

Referring now to FIGS. 1 and 2 of the drawings as a whole, there is seen a friction spinning machine 1 having two friction surfaces 3, 4 which are movable in opposing directions, forming a spinning wedge 2. The friction surfaces 3, 4 are constructed in the form of perforated drums. During the spinning operation the drums rotate in the same sense, in the direction of the arrows 5, 6.

Due to the fact that the drums rotate in the same direction, the friction surfaces thereof move in opposing directions at the spinning wedge 2. Spinning fibers 7 are conducted through a funnel 8 into the spinning wedge 2. A spun thread 11 is pulled by a pair of delivering or discharging rollers 9, 10 from the spinning zone or spinning wedge 2. The roller 9 has its own drive, while the roller 10 is a pressure roller, and can be lifted from the roller 9 in the direction of an arrow 12.

Each of the two drums 3, 4 are provided with a respective suction device 13, 14. The two suction devices 13, 14 act on the spinning wedge 2 by virtue of the fact that they have slit-shaped suction nozzles 15, 16 respectively, directed against the lower end of the spinning wedge 2. The thread 11 is formed on the friction surfaces 3 and 4 in the wedge.

The friction spinning machine 1 includes a thread joining device 17 which serves for starting the operation and eliminating a thread break. The thread joining device 17 is provided with two pairs of rollers 18, 19, 20, 21 between which a suction tube 22 is guided. The rollers 19 and 21 are grooved or profiled for guiding the suction tube 22. All of the rollers are coated with a rubber-elastic coating for this purpose. Only the roller 20 is a drive roller. The far end of the suction tube 22 is connected by a hose line 23 to a source 24 of suction air which can be turned on and off at times. The suction devices 13 and 14 are also connected to non-illustrated sources of suction air which can be turned on and off. The rotational drives of the drums 3 and 4 are also not illustrated.

When the thread 11 breaks, first of all, the fiber feed is stopped, and the motion of the friction surfaces is brought to a stand still. This can be accomplished automatically, such as by a thread monitor which controls the fiber supply or feeding device and the two drums 3 and 4. The suction flow is then stopped, such as by interrupting the air suction of the two suction devices 13 and 14. The above-mentioned operations can be started at the same time. The suction tube 22, which is supplied with suction air is then moved from the back to the front through the spinning wedge 2. In order to perform this function, the roller 20 is rotated in the direction of the arrow. All of the other rollers guiding the suction tube 22 thus rotate without having their own drive. In certain cases, the suction in the suction tube 22 is only activated at this point. As the end of the suction tube 22 is pushed forward along the spinning wedge 2 until it lies in the position 22', threads and fiber remainders are sucked from the spinning wedge 2, and from adjacent parts of the friction surfaces 3 and 4. At this point the end of the broken thread is sucked in through the suction tube 22. In this case, the roller 10 can be lifted from the roller 9 in the direction of the arrow 12. The return of the thread end can also be aided by the fact that the roller 9 rotates against the direction of the arrow 25, and the roller 10 contacts the roller 9. When the thread end is sucked in through the suction tube 22, the suction tube 22 moves back to its starting position, and thus deposits the thread into the spinning wedge 2. The return of the suction tube 22 is effected by driving the roller 20 against the direction of the arrow 26.

As soon as the thread again lies in the spinning wedge 2, the suction devices 13 and 14 are again supplied with suction air, and the friction surfaces 3 and 4 are first rotated in a direction opposing the direction used during the spinning operation, in other words against the direction of the arrows 5 and 6, in order to open up the fibers. After this is accomplished the friction surfaces 3 and 4 are stopped again. The feeding of the fibers 7 is then resumed again, i.e. the fiber supply device which is not shown in detail, is again set in operation. The friction surfaces 3 and 4 are then operated with increasing speed in the direction of the arrows 5 and 6, and the fiber guidance, the motion of the friction surfaces, and the fiber withdrawal with the aid of the roller pair 9, 10, are coordinated with each other and adjusted until the normal spinning operation is resumed. The coordination mainly serves the purpose of generating a thread of specified fineness and twist with a predetermined speed.

Suitable variations are possible in the above-described sequence of operational steps. When initially starting the operation, the first two steps can be omitted.

The invention is not limited to the illustrated and described specific embodiments used as example.

As the twist is removed from the thread end, at slight but effective negative pressure, a generally desirable interruption of the thread is produced. The new end created thereby has a tuft of fibers which facilitates the start of the spinning operation. During this procedure the thread is held on one side by the pair of withdrawal rollers 9, 10, and on the other side by the negative pressure existing in the suction tube 22. If the thread end extends into the tube line 23, it is additionally, mechanically held, so that it lies against the tube wall in vicinity of the deflection. Instead of being held by a pair of withdrawal rollers, the thread can also be held in a construction wherein it contacts a deflection point.

The foregoing is a description corresponding in substance to German application No. P 33 17 369.9, dated May 13, 1983, the International priority of which is being claimed for the instant application, and which is hereby made part of this application. Any material discrepancies between the foregoing specification and the aforementioned corresponding German application are to be resolved in favor of the latter.

I claim:

1. Method for starting the operation of a friction spinning machine, including friction surfaces movable in opposing directions for forming a spinning wedge; the friction surfaces being movable in a spinning direction during a spinning operation, a device for supplying fiber to the spinning wedge, at least one suction device acting on the spinning wedge, a suction tube supplied with suction air, and a thread withdrawal device, which comprises:

stopping the fiber supply and the motion of the friction surfaces;

stopping the suction;

moving the suction tube through the spinning wedge in a given direction for sucking in thread and fiber remains;

subsequently sucking a thread through the suction tube;

moving the suction tube out of the spinning wedge in a direction opposite said given direction depositing the thread in the spinning wedge;

resuming the suction at least as late as the step of moving the suction tube out of the spinning wedge;

moving the friction surfaces in a direction opposite the spinning direction removing the twist of the thread and loosening the thread;

subsequently stopping the motion of the friction surfaces again;

starting the fiber supply again;

moving the friction surfaces in the spinning direction with increased speed; and coordinating and increasing the fiber supply, the motion of the friction surfaces and the thread withdrawal until a normal spinning operation is established.

2. Method according to claim 1, which comprises holding the thread in a fixed position outside the spinning wedge, at least during the step of removing the thread twist.

3. Method according to claim 1, which comprises loosening the fiber formation during the step of removing the thread twist, separating the thread with the suction air, and sucking away a severed thread portion.

4. Method according to claim 2, which comprises loosening the fiber formation during the step of removing the thread twist, separating the thread with the suction air, and sucking away a severed thread portion.

5. Apparatus for starting the operation of a friction spinning machine, including friction surfaces movable in opposing directions for forming a spinning wedge, a device for supplying fiber to the spinning wedge, a thread withdrawal device for withdrawing thread in a given direction, and at least one suction device acting on the spinning wedge, comprising a suction tube supplied with suction air, said suction tube being movable back and forth through the spinning wedge along the given thread withdrawal direction and a direction opposite thereto.

* * * * *